US009508515B2

(12) United States Patent
Masuda et al.

(10) Patent No.: US 9,508,515 B2
(45) Date of Patent: Nov. 29, 2016

(54) ELECTROSTATIC RELAY

(71) Applicant: OMRON Corporation, Kyoto (JP)

(72) Inventors: Takahiro Masuda, Kyoto (JP); Junya Yamamoto, Shiga (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 14/634,231

(22) Filed: Feb. 27, 2015

(65) Prior Publication Data

US 2015/0170863 A1 Jun. 18, 2015

Related U.S. Application Data

(62) Division of application No. 12/977,777, filed on Dec. 23, 2010, now abandoned.

(30) Foreign Application Priority Data

Mar. 12, 2010 (JP) ..... 2010-055556

(51) Int. Cl.
*H01H 59/00* (2006.01)
*H01H 45/14* (2006.01)
*H01H 1/00* (2006.01)

(52) U.S. Cl.
CPC ..... *H01H 59/0009* (2013.01); *H01H 45/14* (2013.01); *H01H 2001/0078* (2013.01); *H01H 2221/036* (2013.01); *H01H 2235/02* (2013.01); *H01H 2239/008* (2013.01)

(58) Field of Classification Search
CPC ..... H01H 59/0009; H01H 1/0036
See application file for complete search history.

(56) References Cited

U.S. PATENT DOCUMENTS

| | | | | |
|---|---|---|---|---|
| 5,415,043 | A * | 5/1995 | Zabler et al. | 73/514.38 |
| 5,554,304 | A * | 9/1996 | Suzuki | 216/2 |
| 6,628,039 | B2 * | 9/2003 | Dhuler | 310/306 |
| 7,489,228 | B2 * | 2/2009 | Robert | 337/89 |
| 2003/0102936 | A1 * | 6/2003 | Schaefer | 333/105 |
| 2004/0189142 | A1 * | 9/2004 | Knieser et al. | 310/309 |
| 2009/0260960 | A1 * | 10/2009 | Gritters et al. | 200/181 |
| 2009/0260962 | A1 * | 10/2009 | Martens et al. | 200/242 |
| 2010/0181173 | A1 * | 7/2010 | Rodriguez et al. | 200/181 |

* cited by examiner

*Primary Examiner* — Mohamad Musleh
(74) *Attorney, Agent, or Firm* — Osha Liang LLP

(57) ABSTRACT

In an electrostatic relay in which a moving contact and a movable electrode are displaced in parallel with a base substrate, an opening force is increased when the movable electrode is separated from a fixed electrode, and a structure is simplified to enhance a degree of freedom of design. A fixed contact portion and a fixed electrode portion are fixed to the base substrate. The fixed electrode portion and a movable electrode portion constitute an electrostatic actuator that displaces the movable electrode portion and a moving contact portion. A movable spring provided in a spring supporting portion retains the movable electrode portion in a displaceable manner. A cantilever secondary spring is provided in the spring supporting portion, and a projection portion is provided in a front end face of the movable electrode portion. The secondary spring abuts on the projection portion while being not deformed until abutting on the projection portion, before the moving contact of the moving contact portion abuts on the fixed contact of the fixed contact portion when the moving contact portion and the movable electrode portion are displaced.

2 Claims, 9 Drawing Sheets

ELECTROSTATIC RELAY

BACKGROUND OF THE INVENTION

1. Technical Field

The present invention relates to a compact electrostatic relay (electrostatic micro-relay), specifically to a structure of a secondary spring that elastically restores a movable portion in an electrostatic relay.

2. Related Art

In the electrostatic relay, when a moving contact is brought into contact with a fixed contact, an electrostatic actuator is driven to displace the moving contact. When the moving contact and the fixed contact are separated from each other, the moving contact is separated from the fixed contact by an elastic restoring force of a movable spring that is elastically deformed in driving the electrostatic actuator.

In driving the electrostatic actuator, a DC voltage is applied between a movable electrode and a fixed electrode, and the movable electrode is attracted to the fixed electrode by an electrostatic force that acts between the electrodes, thereby displacing a member in which the movable electrode is provided. However, in the electrostatic actuator, due to electrostatic induction or induction polarization generated between the electrodes, occasionally the movable electrode is attracted to and not separated from fixed electrode even if the DC voltage applied between the movable electrode and the fixed electrode is turned off. Further, occasionally the moving contact and the fixed contact are not separated by an adhesive force that is generated when the fixed contact and the moving contact come into contact with each other. Therefore, when the movable electrode is attracted to the fixed electrode, or when the moving contact is in contact with the fixed contact, it is necessary to increase a spring modulus of the movable spring.

For example, Japanese Unexamined Patent Publication No. 6-203726 discloses a contact switchgear in which the spring modulus of the movable spring is increased when the moving contact comes into contact with the fixed contact. FIG. 1A is a perspective view showing a structure of the contact switchgear disclosed in Japanese Unexamined Patent Publication No. 6-203726. In the contact switchgear of FIG. 1A, a base end portion of a movable spring 13 is fixed in a cantilever manner to a moving contact terminal 12 that is vertically provided in an upper surface of a base 11. A moving contact 14 is fixed to a leading end portion of the movable spring 13 that extends in parallel with the upper surface of the base 11. A fixed contact 16 is fixed opposite the moving contact 14 in an upper end portion of a fixed contact plate 15 that is vertically provided in the upper surface of the base 11. An operation controlling member 17 bent into an L-shape is attached to the upper end portion of the fixed contact plate 15, and a leading end 17*a* of the operation controlling member 17 is opposite the leading end portion of the movable spring 13.

When a rear surface of the movable spring 13 is pressed by a driving member 18, the movable spring 13 is elastically curved, and the leading end portion of the movable spring 13 abuts on the leading end 17*a* of the operation controlling member 17. When the movable spring 13 is further pressed by the driving member 18, the moving contact 14 is pressed on the fixed contact 16 to close between the moving contact 14 and the fixed contact 16. In the contact switchgear disclosed in Japanese Unexamined Patent Publication No. 6-203726, the movable spring 13 abuts on the operation controlling member 17 before the moving contact and the fixed contact come into contact with each other, thereby achieving shock relaxation of the contact and reduced contact bounce time.

In the contact switchgear disclosed in Japanese Unexamined Patent Publication No. 6-203726, when the moving contact 14 is brought into contact with the fixed contact 16, the movable spring 13 abuts on the leading end 17*a* of the operation controlling member 17 to increase the spring modulus of the movable spring 13. However, in the contact switchgear disclosed in Japanese Unexamined Patent Publication No. 6-203726, because a driving force of the driving member 18 is the electromagnetic force, the spring modulus of the movable spring 13 is not increased in order to separate the movable electrode and fixed electrode of the electrostatic actuator. Additionally, in the contact switchgear, while the moving contact 14 is in contact with the fixed contact 16, the movable spring 13 is separated from the leading end 17*a* of the operation controlling member 17 as shown in FIG. 1B, and the spring modulus of the movable spring 13 is returned to the original spring modulus.

Japanese Unexamined Patent Publication No. 2000-164104 discloses an electrostatic micro-relay, in which a movable substrate having a spring property is overlapped on a substrate in which a fixed contact and a fixed electrode are provided, and a moving contact that is opposite the fixed contact and a movable electrode that is opposite the fixed electrode are provided in a lower surface of the movable substrate. In the electrostatic micro-relay, a projection portion is provided in at least one of the movable electrode and the fixed electrode, the projection portion is brought into contact with the other of the movable electrode and the fixed electrode before the moving contact and the fixed contact abut on each other, and the opening force is increased by an elastic deformation partially generated in the movable spring near the projection portion.

In the electrostatic relay, although the original spring modulus of the movable spring can arbitrarily be increased by a position or a height of the projection portion, there is a restriction to the position or the height, which results in a problem in that a degree of freedom of design is degraded by processing preciseness or troublesome design.

SUMMARY

The present invention has been devised to solve the problems described above, and an object thereof is to increase an opening force when the movable electrode is separated from the fixed electrode, to simplify the structure, and to enhance the degree of freedom of the design in an electrostatic relay in which the moving contact and the movable electrode are displaced in parallel with the base substrate.

In accordance with an aspect of the present invention, an electrostatic relay includes: a base substrate; a fixed contact portion that is fixed to the base substrate, the fixed contact portion including a fixed contact; a moving contact portion that includes a moving contact to be brought into contact with or separated from the fixed contact; a fixed electrode portion that is fixed to the base substrate; a movable electrode portion that is displaced along with the moving contact portion toward a direction parallel to the base substrate by an electrostatic force generated between the fixed electrode portion and the movable electrode portion; a first spring member that returns the displaced movable electrode portion to an original position; and a second spring member that abuts on one of a fixed portion fixed to the base substrate and the movable electrode portion or a movable portion displaced along with the movable electrode portion while being not deformed until abutting on one of the fixed portion and the movable electrode portion or the movable portion before the moving contact portion abuts on the fixed contact when the moving contact portion and the movable electrode portion are displaced, the second spring member being provided in the other of the fixed portion and the movable portion. The fixed portion is a member that is fixed to the base substrate. The fixed portion may be the fixed contact portion or the fixed electrode portion or a fixed member (for example, the spring supporting portion) except the fixed contact portion and the fixed electrode portion. The movable member may be the moving contact portion or a member except the moving contact portion. However, when the member in which the second spring member is provided is the fixed electrode portion or the fixed contact portion while the member on which the second spring member abuts is the movable electrode portion or the moving contact portion, or when the member in which the second spring member is provided is the movable electrode portion or the moving contact portion while the member on which the second spring member abuts is the fixed electrode portion or the fixed contact portion, it is necessary that the second spring member has an insulating property.

In the electrostatic relay according to the aspect of the present invention, the second spring member that is different from the first spring member is provided in the other of the fixed portion and the movable electrode portion or the movable portion, and the second spring member is not deformed until abutting on one of the fixed member and movable electrode portion or the movable member. Therefore, the structure that elastically returns the movable electrode portion or the movable portion can be simplified to facilitate production of the electrostatic relay. Additionally, because the spring modulus of the second spring member and a moving distance of the movable portion in changing the spring modulus can independently be determined, the degree of freedom of the design is enhanced to facilitate the design of the electrostatic relay.

In the electrostatic relay according to the aspect of the present invention, preferably the second spring member is a plate spring that is fixed in a cantilever manner to the other of the fixed portion and the movable electrode portion or the movable portion. Accordingly, because the second spring member is formed into the cantilever shape, a displacement amount can be increased compared with the case where the second spring member is provided in a fixed-fixed beam manner, and the cantilever second spring member can deal with the large displacement amount of the movable portion.

In the electrostatic relay according to the aspect of the present invention, preferably the second spring member is not connected to one of the fixed portion and the movable electrode portion or the movable portion. Accordingly, the second spring member is not deformed until the second spring member abuts on one of the fixed member and the movable electrode portion or the movable member.

In the electrostatic relay according to the aspect of the present invention, preferably the second spring member abuts on a projection portion that is provided in one of the fixed portion and the movable electrode portion or the movable portion. Accordingly, a point of action of a force applied to the second spring member is changed by changing the position of the projection portion, so that the spring modulus of the second spring member can be changed.

In the electrostatic relay according to the aspect of the present invention, preferably a plate-shaped second spring member that is provided in a cantilever manner to the other of the fixed portion and the movable electrode portion or the movable portion can abut one a projection portion that is provided in one of the fixed portion and the movable electrode portion or the movable portion, and a length direction of the second spring member that is not deformed is parallel to a surface in which the projection portion is provided. Accordingly, the design is facilitated, because a distance between the projection portion and the second spring member is not changed even if the position of the projection portion is changed along a surface in which the projection portion is provided.

In the electrostatic relay according to the aspect of the present invention, preferably the second spring member is provided in a spring supporting portion fixed to the base substrate between the movable electrode portion and the fixed contact portion. Accordingly, the spring supporting portion that retains the second spring member can be provided by utilizing spaces on both sides of the moving contact portion.

In the electrostatic relay according to the aspect of the present invention, preferably second spring members are provided at positions that are symmetrical in relation to a center line of the movable electrode portion. Accordingly, because the second spring members are symmetrically provided, a force applied to the movable portion becomes asymmetric after the fixed portion or the movable portion abuts on the second spring member, and there is no risk of inclining the movable portion.

In the electrostatic relay according to the aspect of the present invention, preferably the first spring members are provided in both end faces in the direction in which the movable electrode portion is displaced, or the first spring members are provided opposite the end faces, respectively. Accordingly, because the movable electrode portion can float from the base substrate by retaining the movable electrode portion from both sides with the first spring member, the movable electrode portion can be stabilized.

In the electrostatic relay according to the aspect of the present invention, preferably the first spring member is provided in one of end faces in the direction in which the movable electrode portion is displaced, or the first spring member is provided opposite one of the end faces. Accordingly, because the first spring member is provided only on one side of the movable electrode portion, the structure of the electrostatic relay can be simplified and miniaturized.

The means for solving the problem in the present invention has the feature that the above constituents are appropriately combined, and many variations can be made by combining the constituents in the present invention.

DETAILED DESCRIPTION

Hereinafter, preferred embodiments of the present invention will be described with reference to the drawings. However, the present invention is not limited to the following embodiments, but various design changes can be made without departing from the scope of the present invention.

First Embodiment

Figure 1A:
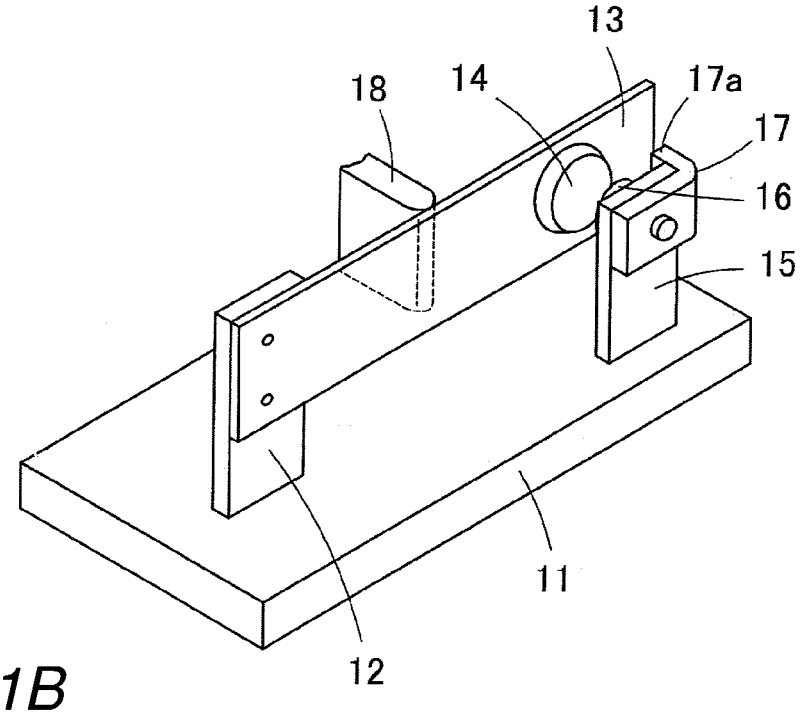
FIG. 1A PRIOR ART
FIG. 1A is a perspective view of a contact switchgear disclosed in Japanese Unexamined Patent Publication No. 6-203726.
Figure 1B:
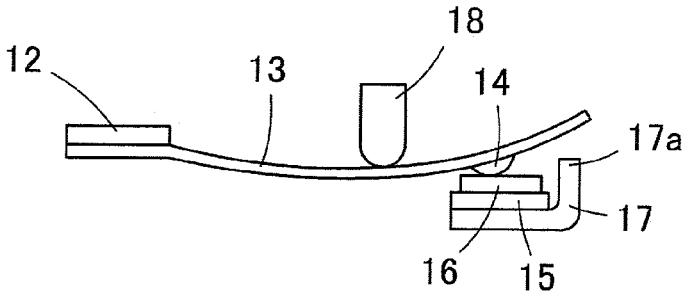
FIG. 1B PRIOR ART
FIG. 1B is a plan view of the contact switchgear when contacts come into contact with each other.
Figure 2:
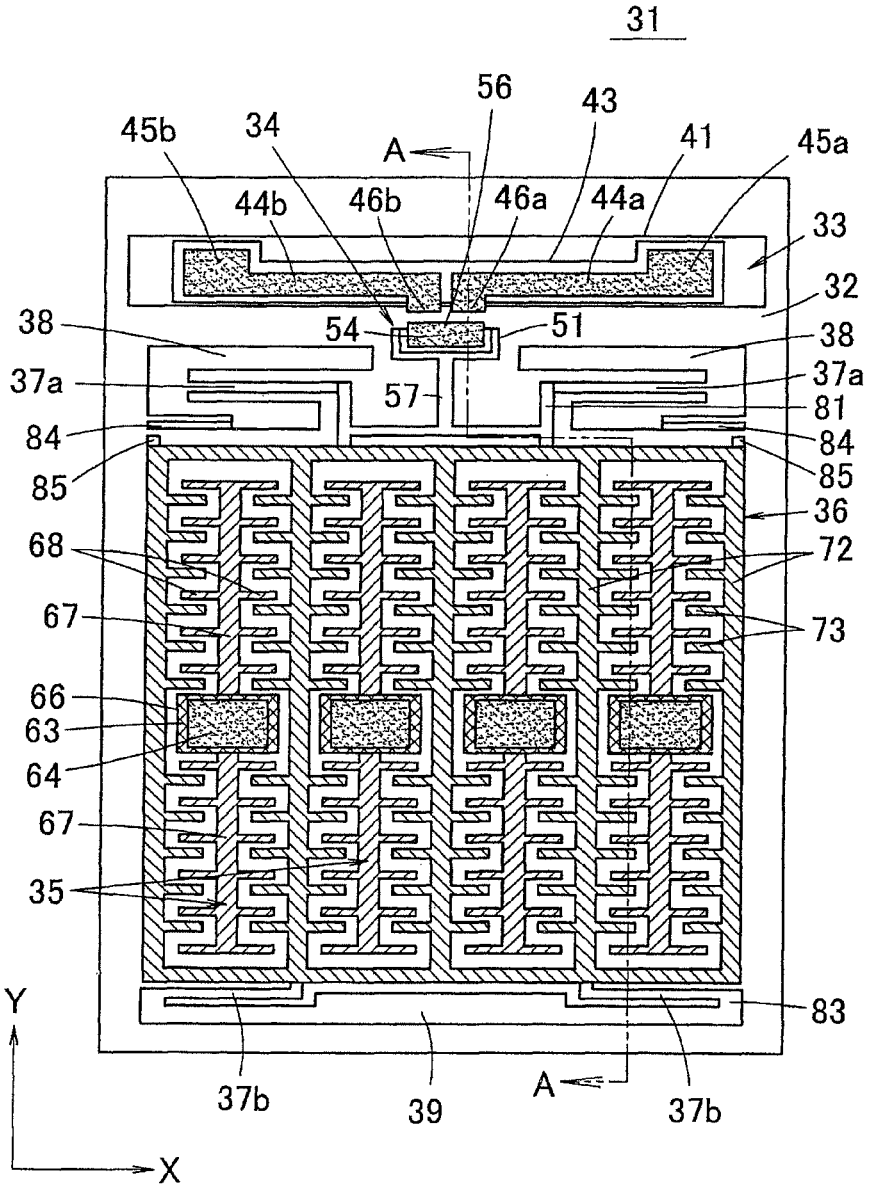
FIG. 2 is a plan view showing an electrostatic relay according to a first embodiment of the present invention.

FIG. 2 is a plan view showing a structure of an electrostatic relay 31 according to a first embodiment of the present invention. FIG. 7B is a sectional view taken on a line A-A of FIG. 2. The structure of the electrostatic relay 31 will be described with reference to FIGS. 2 and 7B.

A fixed contact portion 33, a moving contact portion 34, a fixed electrode portion 35, a movable electrode portion 36, movable springs 37*a* and 37*b* (first spring member), and spring supporting portions 38 and 39 are provided in an upper surface of a base substrate 32 formed by an Si substrate in the electrostatic relay 31. In the electrostatic relay 31, a switch is formed by the fixed contact portion 33 and the moving contact portion 34, and an electrostatic actuator for opening and closing the switch is formed by the fixed electrode portion 35, the movable electrode portion 36, the movable springs 37*a* and 37*b*, and the spring supporting portions 38 and 39.

As shown in FIGS. 2 and 7B, in the fixed contact portion 33, a lower surface of an Si fixed contact substrate 41 is fixed to an upper surface of the base substrate 32 through a $SiO_2$ insulating film 42. The fixed contact substrate 41 extends long in a width direction (X-direction) in an upper-surface end portion of the base substrate 32. An SiN insulating layer 43 is formed in the upper surface of the fixed contact substrate 41, and a pair of wiring pattern portions 44*a* and 44*b* is provided on the insulating layer 43. The wiring pattern portions 44*a* and 44*b* are horizontally divided in the upper surface of the fixed contact substrate 41, and metallic pad portions 45*a* and 45*b* are formed in end portions of the wiring pattern portions 44*a* and 44*b*. The end portions of the wiring pattern portions 44*a* and 44*b*, located in a central portion of the fixed contact substrate 41, extend in parallel with each other, and the end portions located opposite the moving contact portion 34 constitute fixed contacts 46*a* and 46*b*. Hereinafter, occasionally a direction in which the moving contact portion 34 and the movable electrode portion 36 move in the electrostatic relay 31 is referred to as a Y-direction, and a width direction of the electrostatic relay 31 is referred to as an X-direction.

The moving contact portion 34 is provided opposite the fixed contacts 46*a* and 46*b*. In the moving contact portion 34, an SiN insulating layer 53 is formed on an upper surface of an Si moving contact substrate 51, and a contact layer 54 is formed on the insulating layer 53. An end face of the contact layer 54 that is opposite fixed contacts 46*a* and 46*b* is projected from a front face of the moving contact substrate 51 to constitute a moving contact 56.

The moving contact substrate 51 is supported in a cantilever manner by a support beam 57 that is projected from the movable electrode portion 36. The lower surfaces of the moving contact substrate 51 and support beam 57 float from the upper surface of the base substrate 32, and the moving contact substrate 51 and the support beam 57 can move along with the movable electrode portion 36 in a length direction (Y-direction) of the base substrate 32.

In the electrostatic relay 31, a main circuit (not shown) is connected to the metallic pad portions 45*a* and 45*b* of the fixed contact portion 33, and the main circuit can be closed by bringing the moving contact 56 into contact with the fixed contacts 46*a* and 46*b*. The main circuit can be opened by separating the moving contact 56 from the fixed contacts 46*a* and 46*b*.

An electrostatic actuator that moves the moving contact portion 34 includes the fixed electrode portion 35, the movable electrode portion 36, the movable springs 37*a* and 37*b*, and the spring supporting portions 38 and 39.

As shown in FIG. 2, plural fixed electrode portions 35 are disposed in parallel with one another in the upper surface of the base substrate 32. When the fixed electrode portion 35 is viewed from above, branch-shaped electrodes 67 extend toward the Y-direction from both surfaces of a rectangular pad portion 66. In the branch-shaped electrode 67, branch portions 68 are projected so as to become horizontally symmetrical, and the branch portions 68 are arrayed in the Y-direction at constant intervals.

As shown in FIG. 7B, in the fixed electrode portion 35, a lower surface of a fixed electrode substrate 61 is fixed to the upper surface of the base substrate 32 by an $SiO_2$ insulating film 62. A conductive layer 63 is formed on the upper surface of the fixed electrode substrate 61 in the pad portion 66, and the pad portion 66 includes an electrode pad layer 64 on the conductive layer 63.

As shown in FIG. 2, the movable electrode portion 36 is formed into a frame shape so as to surround each fixed electrode portion 35. In the movable electrode portion 36, comb-shaped electrodes 72 are formed so as to sandwich the fixed electrode portions 35 from both sides therebetween (the pair of comb-shaped electrodes 72 is formed into the branch shape between the fixed electrode portions 35). The comb-shaped electrode 72 is symmetrical in relation to each fixed electrode portion 35, and comb-shaped portions 73 extend from each comb-shaped electrode 72 toward a gap portion between the branch portions 68. In each comb-shaped portion 73, a distance from the branch portion 68 that is adjacent to the comb-shaped portion 73 and located closer to the moving contact portion 34 is shorter than a distance from the branch portion 68 that is adjacent to the comb-shaped portion 73 and located farther away from the moving contact portion 34.

The movable electrode portion 36 is formed by an Si movable electrode substrate 71, and the lower surface of the movable electrode substrate 71 floats from the upper surface of the base substrate 32. The support beam 57 is projected in the center of the end face on the moving contact side of the movable electrode portion 36, and the moving contact substrate 51 is retained at a leading end of the support beam 57.

The movable electrode portion 36 is retained by the movable spring 37*a* supported by the spring supporting portion 38 and the movable spring 37*b* supported by the spring supporting portion 39. As shown in FIG. 2, the two spring supporting portions 38 are symmetrically disposed in a region between the fixed contact portion 33 and the movable electrode portion 36. The spring supporting portion 38 made of Si is fixed to the upper surface of the base substrate 32 through an insulating film (not shown). In a front end face of the movable electrode portion 36, coupling portions 81 are projected in the Y-direction from both sides of the support beam 57. A leading end of the coupling portion 81 and the spring supporting portion 38 are coupled by the plate-shaped or beam-shaped movable spring 37*a* made of Si. The movable spring 37*a* is parallel to an X-direction when being not deformed.

The spring supporting portion 39 made of Si extends in the X-direction in the rear end portion of the base substrate 32. The lower surface of the spring supporting portion 39 is fixed to the upper surface of the base substrate 32 by an insulating film 82. Coupling portions 83 are projected forward from both ends of the spring supporting portion 39, and the coupling portions 83 and the rear end face of the movable electrode portion 36 are connected by the pair of symmetrically-formed movable springs 37*b* made of Si. The movable spring 37*b* is formed into the plate shape or beam shape and disposed in parallel with the X-direction.

Accordingly, the movable electrode portion 36 is retained by the spring supporting portions 38 and 39 with the movable springs 37*a* and 37*b* interposed therebetween, and the movable electrode portion 36 is horizontally retained while floating from the upper surface of the base substrate 32. The movable electrode portion 36 can be displaced in the Y-direction by elastically deforming the movable springs 37*a* and 37*b*, and the movable electrode portion 36 is returned to an original position by elastic restoring forces of the movable springs 37*a* and 37*b* when the electrostatic force displacing the movable electrode portion 36 is released. Because each of the pair of movable springs 37*a* and the pair of movable springs 37*b* has the symmetrical shape, the movable electrode portion 36 can be displaced in the Y-direction while not being able to be displaced in the X-direction when the movable springs 37*a* and 37*b* are deformed to displace the movable electrode portion 36.

In the electrostatic relay 31 having the above-described structure, a DC voltage source is connected between the fixed electrode portion 35 and the movable electrode portion 36, and the DC voltage is applied by a control circuit. In the fixed electrode portion 35, one of terminals of the DC voltage source is connected to the electrode pad layer 64. The other terminal of the DC voltage source is connected to the spring supporting portion 39. The spring supporting portion 39 and the movable spring 37*b* have conductivity, and the spring supporting portion 39, the movable spring 37*b*, and the movable electrode portion 36 are electrically connected. Therefore, the voltage applied to the spring supporting portion 39 is applied to the movable electrode portion 36.

When the DC voltage is applied between the fixed electrode portion 35 and the movable electrode portion 36 by the DC voltage source, an electrostatic attractive force is generated between the branch portion 68 of the branch-shaped electrode 67 and the comb-shaped portion 73 of the comb-shaped electrode 72. However, because the structures of the fixed electrode portion 35 and movable electrode portion 36 are symmetrically formed in relation to a center line of each fixed electrode portion 35, the electrostatic attractive forces acting on the movable electrode portion 36 in the X-direction are balanced, and the movable electrode portion 36 does not move in the X-direction. On the other hand, because the distance from the branch portion 68 that is adjacent to each comb-shaped portion 73 and located closer to the moving contact portion 34 is shorter than the distance from the branch portion 68 that is adjacent to the comb-shaped portion 73 and located farther away from the moving contact portion 34, each comb-shaped portion 73 is attracted to the moving contact portion side, and the movable electrode portion 36 moves in the Y-direction while the movable springs 37*a* and 37*b* are bent. As a result, the moving contact portion 34 moves onto the side of the fixed contact portion 33, and the moving contact 56 comes into contact with the fixed contacts 46*a* and 46*b* to electrically close (the main circuit) between the fixed contact 46*a* and the fixed contact 46*b*.

When the DC voltage applied between the fixed electrode portion 35 and the movable electrode portion 36 is released, the electrostatic attractive force disappears between the branch portion 68 and the comb-shaped portion 73. Therefore, the movable electrode portion 36 is retreated in the Y-direction by the elastic restoring forces of the movable springs 37*a* and 37*b*, and the moving contact 56 is separated from the fixed contacts 46*a* and 46*b* to open (the main circuit) between the fixed contact 46*a* and the fixed contact 46*b*.

In the electrostatic relay 31, because the electrostatic actuator is driven by utilizing the electrostatic force, there is a risk that the moving contact 56 is not separated from the fixed contacts 46*a* and 46*b* even if the DC voltage applied between the fixed electrode portion 35 and the movable electrode portion 36 is released. This is because the electrodes 35 and 36 remain attracted to each other by the induction polarization or the electrostatic induction or the contacts are not separated by the adhesive force generated between the contacts even if the DC voltage applied between the fixed electrode portion 35 and the movable electrode portion 36 is released. Accordingly, in order to separate the fixed contacts 46*a* and 46*b* from the moving contact 56, the movable springs 37*a* and 37*b* having the large spring moduli are required to separate the fixed contacts 46*a* and 46*b* from the moving contact 56. However, when the spring moduli of the movable springs 37*a* and 37*b* are increased, the electrostatic actuator having the stronger electrostatic force is required to displace the movable electrode portion 36.

Therefore, in the electrostatic relay 31, besides the movable spring 37*a* and 37*b*, secondary springs 84 (second spring member) are provided in the spring supporting portions 38, and the elastic restoring forces of the secondary springs 84 are applied when the fixed contacts 46*a* and 46*b* and the moving contact 56 are separated from each other. As shown in FIG. 2, the plate-shaped or beam-shaped secondary springs 84 made of Si are provided in the spring supporting portions 38 at positions at which the secondary springs 84 are opposite the front end face of the movable electrode portion 36. The spring supporting portion 38 is a fixed portion that is fixed to the upper surface of the base substrate 32, and the secondary spring 84 is not joined to the movable portions such as the movable electrode portion 36. When being not deformed, the secondary spring 84 extends in parallel with the front end face of the movable electrode portion 36. On the other hand, projection portions 85 are projected opposite the leading end portions of the secondary springs 84 from the front end face of the movable electrode portion 36.

Figure 3A:
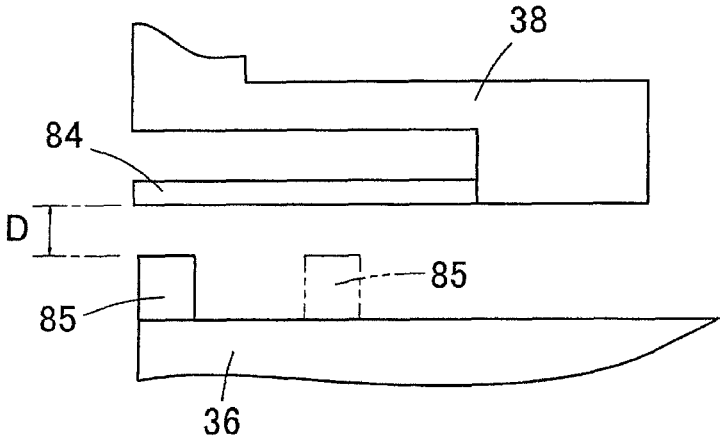
FIGS. 3A to 3C are schematic diagrams explaining an operation between a secondary spring and a projection portion in the electrostatic relay of the first embodiment.
Figure 3B:
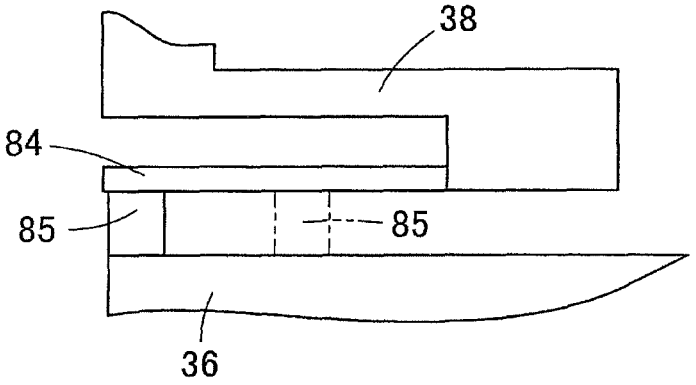
Figure 3C:
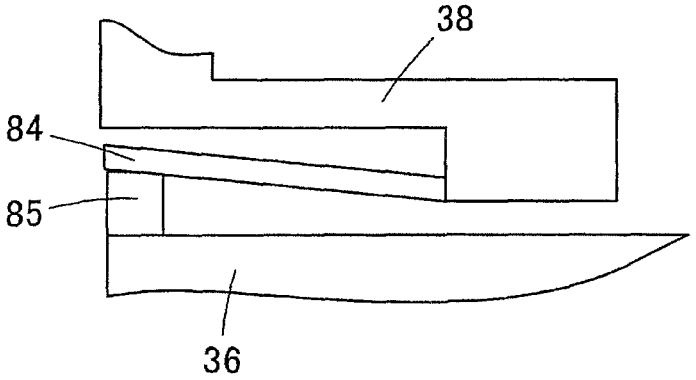

A length of the projection portion 85 or a distance between the leading end of the projection portion 85 and the secondary spring 84 is determined such that an operation shown in FIG. 3 is performed. When the movable electrode portion 36 is not displaced, there is a distance D between the secondary spring 84 and the leading end of the projection portion 85 as shown in FIG. 3A. In driving the electrostatic actuator, the movable electrode portion 36 moves a distance larger than the distance D while bending the movable springs 37*a* and 37*b*. When the movable electrode portion 36 moves the distance D, the leading end of the projection portion 85 abuts on the secondary spring 84 as shown in FIG. 3B. At this point, the moving contact 56 does not yet come into contact with the fixed contacts 46*a* and 46*b*. That is, the projection portion 85 comes into contact with the secondary spring 84 before the moving contact 56 comes into contact with the fixed contacts 46*a* and 46*b*. When the movable electrode portion 36 moves beyond the distance D, as shown in FIG. 3C, the movable electrode portion 36 moves while bending the movable springs 37*a* and 37*b* and the secondary spring 84, and the movable electrode portion 36 stops while bringing the moving contact 56 into contact with the fixed contacts 46*a* and 46*b*.

Accordingly, when the DC voltage applied to the electrostatic actuator is released, the movable electrode portion 36 is pushed back by the elastic restoring forces of the movable springs 37*a* and 37*b* and secondary spring 84, and the movable electrode portion 36 is separated from the fixed electrode portion 35 by the strong force and returned to the original position.

The pair of movable springs 37*a*, the pair of movable springs 37*b*, the pair of secondary springs 84, and the pair of projection portions 85 are symmetrically formed in relation to the center axis parallel to the Y-direction of the movable electrode portion 36 such that the movable electrode portion 36 moves in the Y-direction without inclining the movable electrode portion 36. The pair of movable springs 37*a*, the pair of movable springs 37*b*, and the pair of secondary springs 84 has the identical spring modulus.

In the configuration of the electrostatic relay 31, the secondary springs 84 that are different from the movable springs 37*a* and 37*b* are provided to increase the spring force for returning the movable electrode portion 36, and the secondary springs 84 are not deformed until abutting on the projection portion 85. Therefore, the degree of freedom of the design is enhanced between the secondary spring 84 and the projection portion 85 to facilitate the design. In the structure shown in FIG. 3A, as shown by an alternate long and two short dashes line in FIG. 3A, the spring modulus of the secondary spring 84 can be increased by moving the position of the projection portion 85 onto the base end side of the secondary spring 84. On the other hand, the spring modulus of the secondary spring 84 can be decreased by moving the projection portion 85 onto the leading end side of the secondary spring 84 (because the point of action of the force is changed when the position of the projection portion 85 is changed, moment applied to the secondary spring 84 is changed). Additionally, irrespective of the position of the projection portion 85 even if the position of the projection portion 85 is changed, the projection portion 85 abuts on the secondary spring 84 when the movable electrode portion 36 moves the distance D as shown in FIG. 3B. Therefore, the spring modulus of the secondary spring 84 can be adjusted by the position of the projection portion 85, the moving distance D in which the projection portion 85 abuts on the secondary spring 84 can be adjusted by the length of the projection portion 85, and the spring modulus and the distance D can independently be adjusted, so that the degree of freedom of the design is enhanced.

Figure 4:
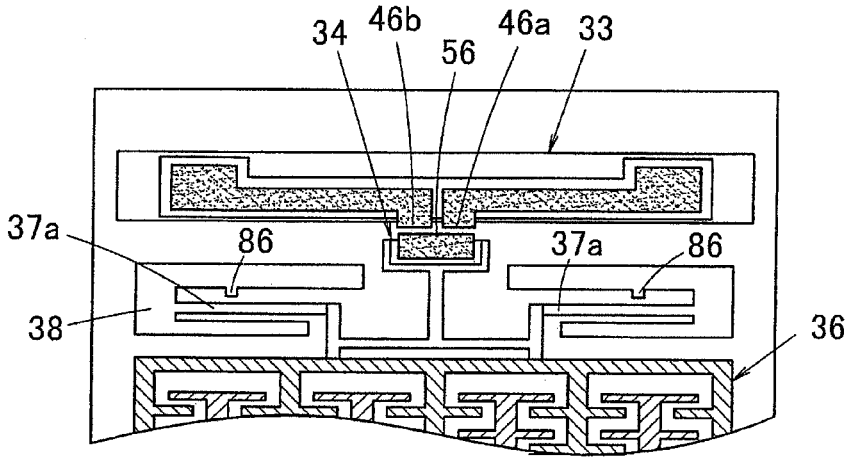
FIG. 4 is a partially cutaway plan view showing an electrostatic relay of a comparative example.

On the other hand, the degree of freedom of the design is degraded, when the movable spring abuts on the operation controlling member after the movable spring is deformed like Japanese Unexamined Patent Publication No. 6-203726, or when the projection portion is provided between the movable portion and the fixed portion like Japanese Unexamined Patent Publication No. 2000-164104. This point becomes clear in consideration of a comparative example shown in FIG. 4. In the comparative example of FIG. 4, a projection 86 (operation controlling member) is provided opposite the movable spring 37*a* such that the movable electrode portion 36 abuts on the projection 86 when moving.

Figure 5A:
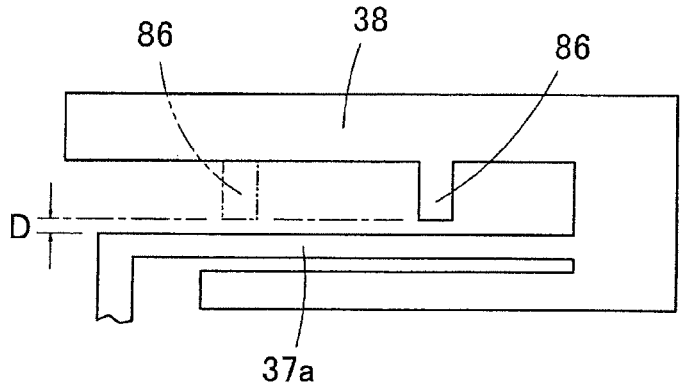
FIGS. 5A to 5C are schematic diagrams explaining an operation between a movable spring and a projection portion in the electrostatic relay of a comparative example.
Figure 5B:
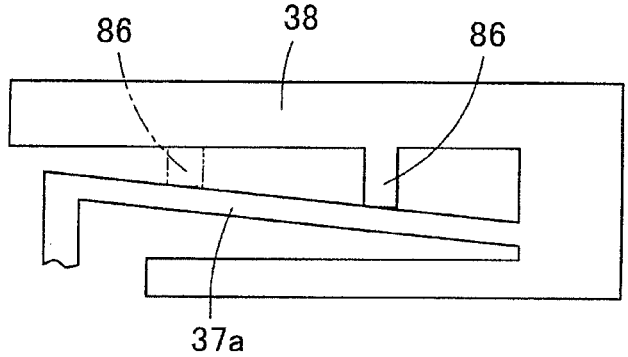
Figure 5C:
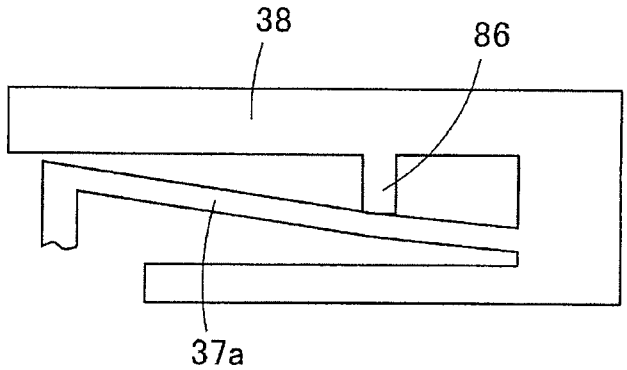

In the comparative example, as shown in FIG. 5A, there is also the distance D between the movable spring 37*a* and the leading end of the projection 86 when the movable electrode portion 36 is not displaced. When the movable electrode portion 36 moves, the movable spring 37*a* abuts on the projection 86 as shown in FIG. 5B. When the movable spring 37*a* abuts on the projection 86 to further move the movable electrode portion 36, because the movable spring 37*a* is deformed with the leading end of the projection 86 as a supporting point as shown in FIG. 5C, the movable spring 37*a* is deformed with the increased spring modulus. Accordingly, when the DC voltage applied to the electrostatic actuator is released, the movable electrode portion 36 is pushed back by the elastic restoring forces of the movable spring 37*b* and movable spring 37*a* whose spring modulus is increased, and the movable electrode portion 36 is separated from the fixed electrode portion 35 by the strong force.

However, in the comparative example, the movable spring 37*a* is bent with the movement of the movable electrode portion 36, and the bent movable spring 37*a* abuts on the leading end of the projection 86 as shown in FIG. 5B. Therefore, exactly it cannot be said that the movable spring 37*a* abuts on the projection 86 when the movable electrode portion 36 moves the distance D. That is, because the moving distance of the movable electrode portion 36 depends on the bending shape of the movable spring 37*a*, the moving distance is larger than the distance D when the movable spring 37*a* abuts on the projection 86.

Even in the comparative example, as shown by an alternate long and two short dashes line in FIG. 5A, the spring modulus of the movable spring 37*a* can be changed by moving the position of the projection 86. However, the moving distance of the movable electrode portion 36 is changed only by simply moving the projection 86 when the movable spring 37*a* abuts on the projection 86. Therefore, in order that the moving distance is not changed when the movable spring 37*a* abuts on the projection 86, it is necessary to adjust the length (projection length) of the projection 86 according to the position of the projection 86 as shown by an alternate long and two short dashes line in FIG. 5B.

In the comparative example, because the position and length of the projection 86 are correlated with each other, the spring modulus of the movable spring 37*a* and the length of the projection 86 (or the moving distance of the movable electrode portion 36 when the spring modulus is changed) cannot independently be determined, and the design becomes complicated. On the other hand, in the first embodiment, the spring modulus of the secondary spring 84 and the moving distance of the movable electrode portion 36 in changing the spring modulus can independently be determined to facilitate the design.

(Producing Method)

Figure 6A:
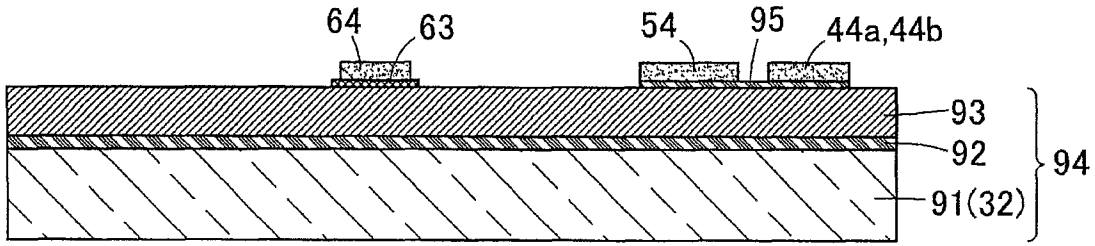
FIGS. 6A to 6C are sectional views showing a process of producing the electrostatic relay of the first embodiment.

A method for producing the electrostatic relay 31 will briefly be described below. A substrate shown in FIG. 6A is an SOI substrate 94 in which an Si substrate 91 and an Si substrate 93 are joined while an oxide film ($SiO_2$) 92 is sandwiched between the Si substrate 91 and the Si substrate 93. The conductive layer 63 and electrode pad layer 64 of the pad portion 66 are formed on the SOI substrate 94, an SiN insulating layer 95 is formed on the SOI substrate 94, and the wiring pattern portions 44*a* and 44*b* of the fixed contact portion 33 and the contact layer 54 of the moving contact portion 34 are formed on the SiN insulating layer 95. The Si substrate 91 that is of the lower-most layer constitutes the base substrate 32.

Figure 6B:
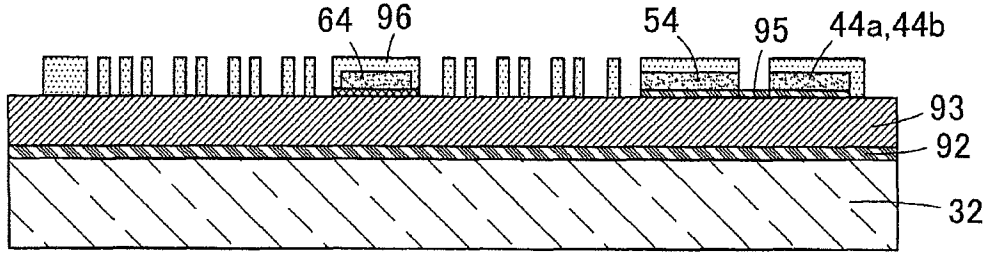

Then, as shown in FIG. 6B, a photoresist film 96 is deposited on the surface of the Si substrate 93, the photoresist film 96 is patterned such that regions constituting the fixed contact portion 33, the moving contact portion 34, the fixed electrode portion 35, the movable electrode portion 36, the movable springs 37*a* and 37*b*, the spring supporting portions 38 and 39, the secondary spring 84, and the projection portion 85 are coated with the photoresist film 96.

Figure 6C:
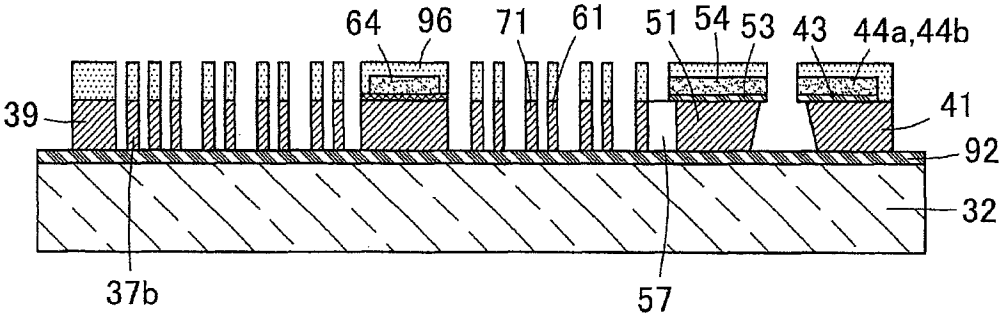

The exposed region of the Si substrate 93 is dry-etched with the photoresist film 96 as an etching mask, and the fixed contact substrate 41 of the fixed contact portion 33, the moving contact substrate 51 of the moving contact portion 34, the fixed electrode substrate 61 of the fixed electrode portion 35, the movable electrode substrate 71 of the movable electrode portion 36, the movable springs 37*a* and 37*b*, the spring supporting portions 38 and 39, the secondary spring 84, and the projection portion 85 (electrostatic actuator and a switch substrate portion) are formed as shown in FIG. 6C. The exposed portion of the insulating layer 95 is etched to form the insulating layer 43 of the fixed contact portion 33 and the insulating layer 53 of the moving contact portion 34.

Figure 7A:
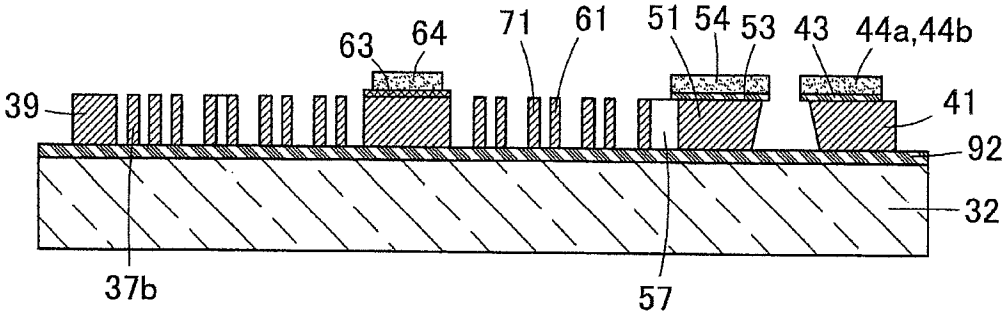
FIGS. 7A and 7B are sectional views showing the process of producing the electrostatic relay of the first embodiment and show a process subsequent to FIG. 6C.
Figure 7B:
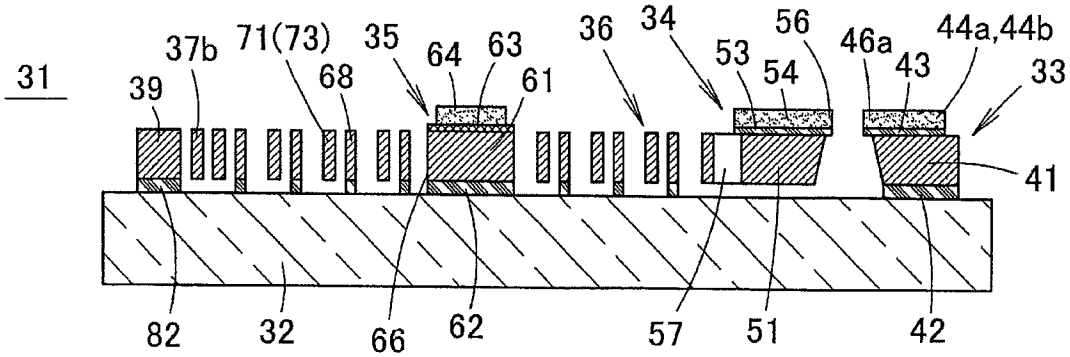

After the photoresist film 96 is peeled off as shown in FIG. 7A, the exposed portion of the oxide film 92 and the oxide films 92 located in the lower surfaces of the moving contact portion 34 and movable portion (the movable electrode portion 36, the movable springs 37*a* and 37*b*, and the secondary spring 84) of the electrostatic actuator are removed by wet etching to prepare the electrostatic relay 31 as shown in FIG. 7B.

(Modification)

Figure 8:
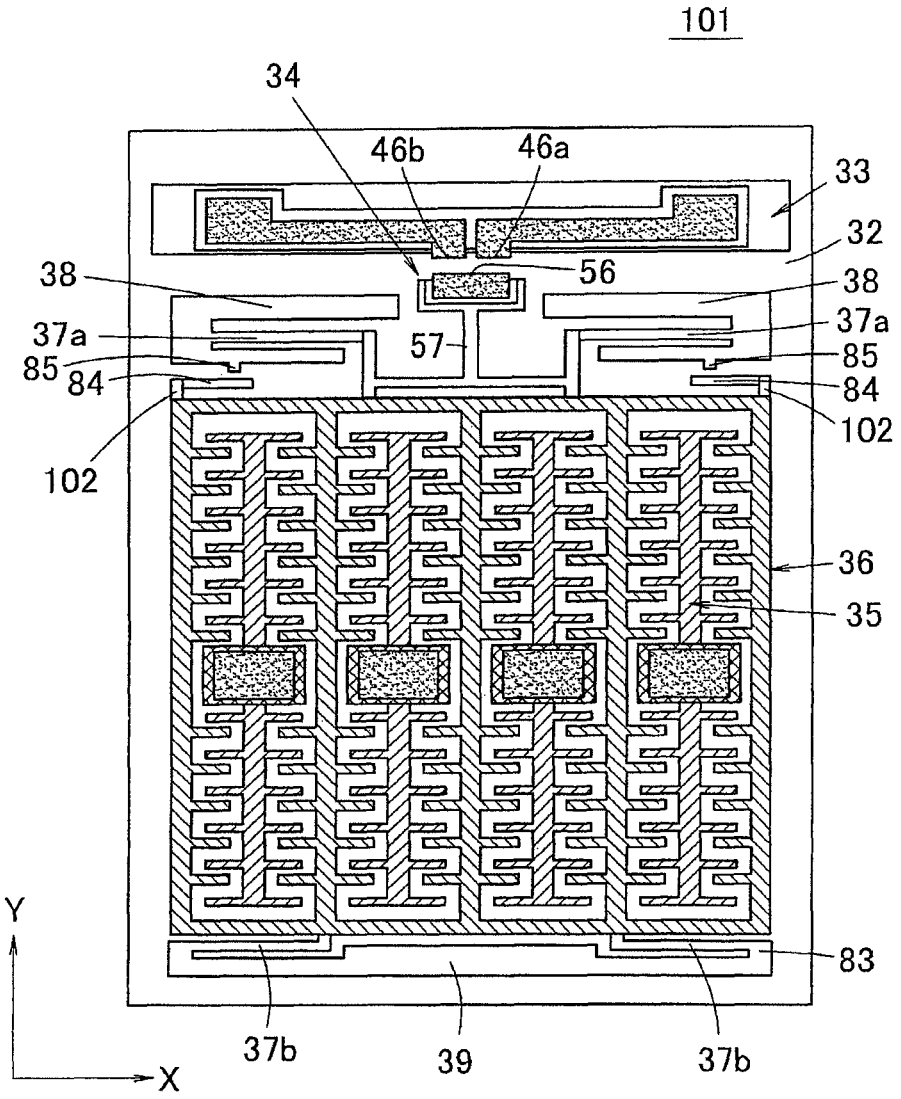
FIG. 8 is a plan view showing an electrostatic relay according to a modification of the first embodiment.

FIG. 8 is a plan view showing an electrostatic relay 101 according to a modification of the first embodiment. In the electrostatic relay 101, coupling portions 102 are projected from both ends in the front end face of the movable electrode portion 36, the secondary springs 84 are provided in the cantilever manner in the leading end portions of the coupling portions 102, and the secondary springs 84 are disposed in parallel with the surfaces of the spring supporting portions 38 that are opposite the secondary springs 84. The projection portion 85 is provided in the surface that is opposite the secondary spring 84 of the spring supporting portion 38 such that the secondary spring 84 abuts on the projection portion 85.

The effect similar to that of the first embodiment can be obtained in the coupling portion 102.

Second Embodiment

Figure 9:
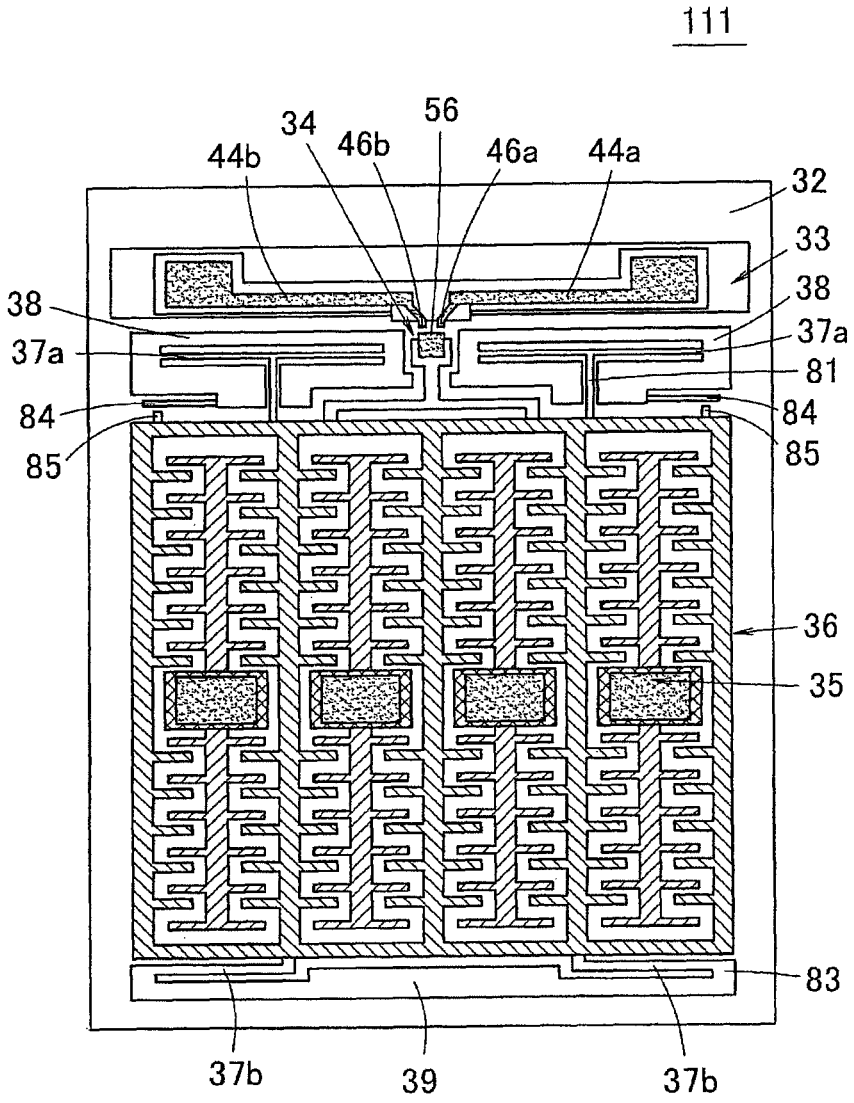
FIG. 9 is a plan view showing an electrostatic relay according to a second embodiment of the present invention.

FIG. 9 is a plan view showing a structure of an electrostatic relay 111 according to a second embodiment of the present invention. In the electrostatic relay 111, a movable spring 37*a* is provided in a fixed-fixed beam manner in the spring supporting portion 38, and the coupling portion 81 that is projected from the front end portion of the movable electrode portion 36 is coupled to the central portion of the movable spring 37*a*. In the structure of the electrostatic relay 111, the movable spring 37*a* constitutes the fixed-fixed beam, so that the spring modulus of the movable spring 37*a* can be increased.

(Other Modifications)

In the first and second embodiments, the movable springs 37*a* and 37*b* that support the movable electrode portion 36 are provided in the front end face and rear end face of the movable electrode portion 36. Alternatively, only one of the movable springs 37*a* and 37*b* may be provided in the front end face or rear end face of the movable electrode portion 36.

The projection portion 85 may be provided in the secondary spring 84 instead of providing the projection portion 85 in the surface that is opposite the secondary spring 84.

The positions at which the secondary spring 84 and the projection portion 85 are provided are not limited to the region between the front end face of the movable electrode portion 36 and the spring supporting portion 38, but the secondary spring 84 and the projection portion 85 may be provided at any position.

What is claimed is:

1. An electrostatic relay comprising:

a base substrate;

a fixed contact portion that is fixed to the base substrate, the fixed contact portion including a fixed contact;

a moving contact portion that includes a moving contact that moves in a moving direction to be brought into contact with or separated from the fixed contact;

a fixed electrode portion that is fixed to the base substrate;

a movable electrode portion that is displaced along with the moving contact portion toward a direction parallel to the base substrate by an electrostatic force generated between the fixed electrode portion and the movable electrode portion;

a spring member that returns the displaced movable electrode portion to an original position; and a projection disposed on the movable electrode portion and projecting in the moving direction that is provided opposite the spring member such that the spring member abuts on the projection when moving.

2. The electrostatic relay according to claim 1, further comprising:

an electrostatic actuator which receives DC voltage for actuation, wherein, when the DC voltage applied to the electrostatic actuator is released, the movable electrode portion is pushed back by an elastic restoring force of the spring member whose spring modulus is increased, thereby separating the movable electrode portion from the fixed electrode portion.

* * * * *